US005245731A

United States Patent [19]

Funathu

[11] Patent Number: 5,245,731

[45] Date of Patent: Sep. 21, 1993

[54] STRAP FOR BINOCULARS

[75] Inventor: Gouzi Funathu, Tokyo, Japan

[73] Assignee: Asahi Kogaku Kogyo Kabushiki Kaisha, Tokyo, Japan

[21] Appl. No.: 800,059

[22] Filed: Nov. 27, 1991

[30] Foreign Application Priority Data

Nov. 29, 1990 [JP] Japan ..... 2-332866
Dec. 25, 1990 [JP] Japan ..... 2-404523

[51] Int. Cl.[5] ..... A44B 11/04
[52] U.S. Cl. ..... 24/200
[58] Field of Search ..... 24/198, 200, 169, 197, 24/308

[56] References Cited

U.S. PATENT DOCUMENTS 2,011,634 8/1935 Hirsh ..... 24/200
2,064,423 12/1936 Giles ..... 24/200 X
2,407,466 9/1946 Alberts ..... 24/200
4,493,135 1/1985 Crook, Jr. ..... 24/200 X
4,843,689 7/1989 Fildan ..... 24/200

FOREIGN PATENT DOCUMENTS 800849 12/1950 Fed. Rep. of Germany ..... 24/200
1807235 12/1969 Fed. Rep. of Germany ..... 24/200

*Primary Examiner*—James R. Brittain
*Attorney, Agent, or Firm*—Kane, Dalsimer, Sullivan, Kurucz, Levy, Eisele and Richard

[57] ABSTRACT

A construction for adjustablly connecting a strap to binoculars. A plurality of movable members are provided on the main body of the binocular. A through-hole for allowing the strap to pass therethrough is provided in the main body. The through hole extends in the direction perpendicular to the optical axes of the eyepiece lenses. Further, a buckle for adjustablly connecting loose ends of the strap is provided. The strap has a pair of side wall members, a hooking crosspiece, the strap being trained around the hooking crosspiece and bent back to be overlapped, an end crosspiece, and an interfering crosspiece arranged between the hooking crosspiece and the end crosspiece. The overlapped portion of the strap passed between the end crosspiece and the interfering crosspiece, and the overlapped portion of the strap is press contacted to the interfering crosspiece when the strap is pulled relative to the buckle.

5 Claims, 5 Drawing Sheets

STRAP FOR BINOCULARS

BACKGROUND OF THE INVENTION

The present invention relates to a strap for hanging an instrument, more specifically, to a strap for an optical instrument such as a camera, a binocular and the like.

Conventionally, a camera or a binocular is hung from a neck when carried on. Generally, a strap is utilized to hang a camera or binocular, and both loose ends of the strap are respectively connected to a camera body or a binocular body. Further, the length of the strap is usually made adjustable to fit for each person who carries the camera or the binocular.

For example, in case of the binocular, a conventional type binocular has a pair of telescopic optical systems which are usually constructed to be foldable or swingable symmetrically about the center of the binocular so that the angle between the pair of the telescopic optical systems with respect to the axis of the swing movement can be adjusted corresponding to a distance between eyes of a user. Both loose ends of the strap are respectively anchored on upper surfaces of the telescopic optical systems by means of metal fittings, which are provided or integrally formed on the upper surfaces of the telescopic optical systems adjacent to eyepiece portions. Thus, the binocular is hung in a well-balanced condition with the eyepiece portion being faced upward when hung from a neck. There has been known a binocular in which the objective lenses are accommodated in a frame in such a manner that the optical axes of the objective lenses are arranged in parallel, the distance therebetween being kept constant, and the eyepiece portions are rotatable about the optical axis of the respective objective lens to adjust the distance between the eyepiece portions so as to correspond to a distance between eyes of an user of the binocular.

However, if the strap is attached to this binocular in the conventional manner, there arises a problem that the adjusted distance between the eyepiece portions may be undesirously changed while hung from the neck through the strap since the loose ends of the strap are connected directly to the foldable or swingable portion of the binocular, i.e., the eyepiece portion. And also it is not desirable in view of optics. For this reason, the strap used to be directly fixed on the immovable frame between the eyepiece portions.

In accordance with the above structure, however, the connecting portions of the strap are inevitably disposed close to the eyepiece portions, which causes the connecting portions to become obstacles when eyes are placed on the eyepiece portions.

That is, the end portion of the strap is usually folded back to overlap when fastened at the connecting portion so that the length of the strap can be adjusted, therefore the rigidity of the strap at the connecting portion is higher than the rest portion of the strap. For this rigidity of the strap, the connecting portion was inherently too hard to avoid interference with eyes when it is suddenly placed before eyes for observation shortly after the connecting portions of the strap have been kept standing in parallel with an optical axes of the eyepiece portions by being hung from a neck or a shoulder.

SUMMARY OF THE INVENTION

It is therefore an object of the present invention to provide an improved construction for adapting a strap to a binocular without interfering with eyes when the binocular is placed before eyes for observation after hung from the neck or shoulder.

It is another object of the present invention to provide a construction for adjustablly connecting a strap to a binocular, wherein the strap is connected to the binocular without interfering with eyes and the length of the strap is easily adjusted.

And, it is further object of the present invention to provide a buckle for connecting loose ends of the strap, with which the length of the strap is easily adjusted, and which has not only a good appearance but also a good grip.

For the above objects, according to the first aspect of the invention, there is provided a construction for connecting a strap to a binocular having a main body and a plurality of movable members which are movable with respect to said main body, wherein a through-hole for allowing said strap to pass therethrough is provided in said main body.

According to second aspect of the invention, there is provided a construction for adjustablly connecting a strap to a binocular, comprising:

a main body;

a plurality of movable members which are movable with respect to said main body, wherein a through-hole for allowing said strap to pass therethrough is provided in said main body; and a buckle for adjustablly connecting loose ends of said strap, wherein said strap having:

a pair of side wall members;

at least one hooking crosspiece, both ends of said hooking crosspiece being connected said pair of side members, respectively, said strap being trained around said hooking crosspiece and bent back to be overlapped;

at least one end crosspiece, both ends of said end crosspiece being connected to the end portions of said side wall members; and at least one interfering crosspiece arranged between said at-least-one hooking crosspiece and said at-least-one end crosspiece, both ends of said interfering crosspiece being connected to said pair of side wall members.

wherein an overlapped portion of said strap passed between said at-least-one end crosspiece and said at-least-one interfering crosspiece, and wherein said overlapped portion of said strap is press contacted to said at-least-one interfering crosspiece when said strap is pulled relative to said buckle member.

According to further aspect of the invention, there is provided a buckle for adjustably connecting loose ends of a strap, comprising:

a pair of side wall members;

at least one hooking crosspiece, both ends of said hooking crosspiece being connected said pair of side members, respectively, said strap being wound around said hooking crosspiece and bent back to be overlapped;

at least one end crosspiece, both ends of said end crosspiece being connected to the end portions of said side wall members; and at least one interfering crosspiece arranged between said at-least-one hooking crosspiece and said at-least-one end crosspiece, both ends of said interfering crosspiece being connected to said pair of side wall members, wherein an overlapped portion of said strap passed between said at-least-one end crosspiece and said at-least-one interfering crosspiece, and wherein said overlapped portion of said strap is press contacted to said at-least-one interfering crosspiece when said strap is pulled relative to said buckle member.

DESCRIPTION OF THE ACCOMPANYING DRAWINGS

DESCRIPTION OF THE EMBODIMENTS

Figure 1:
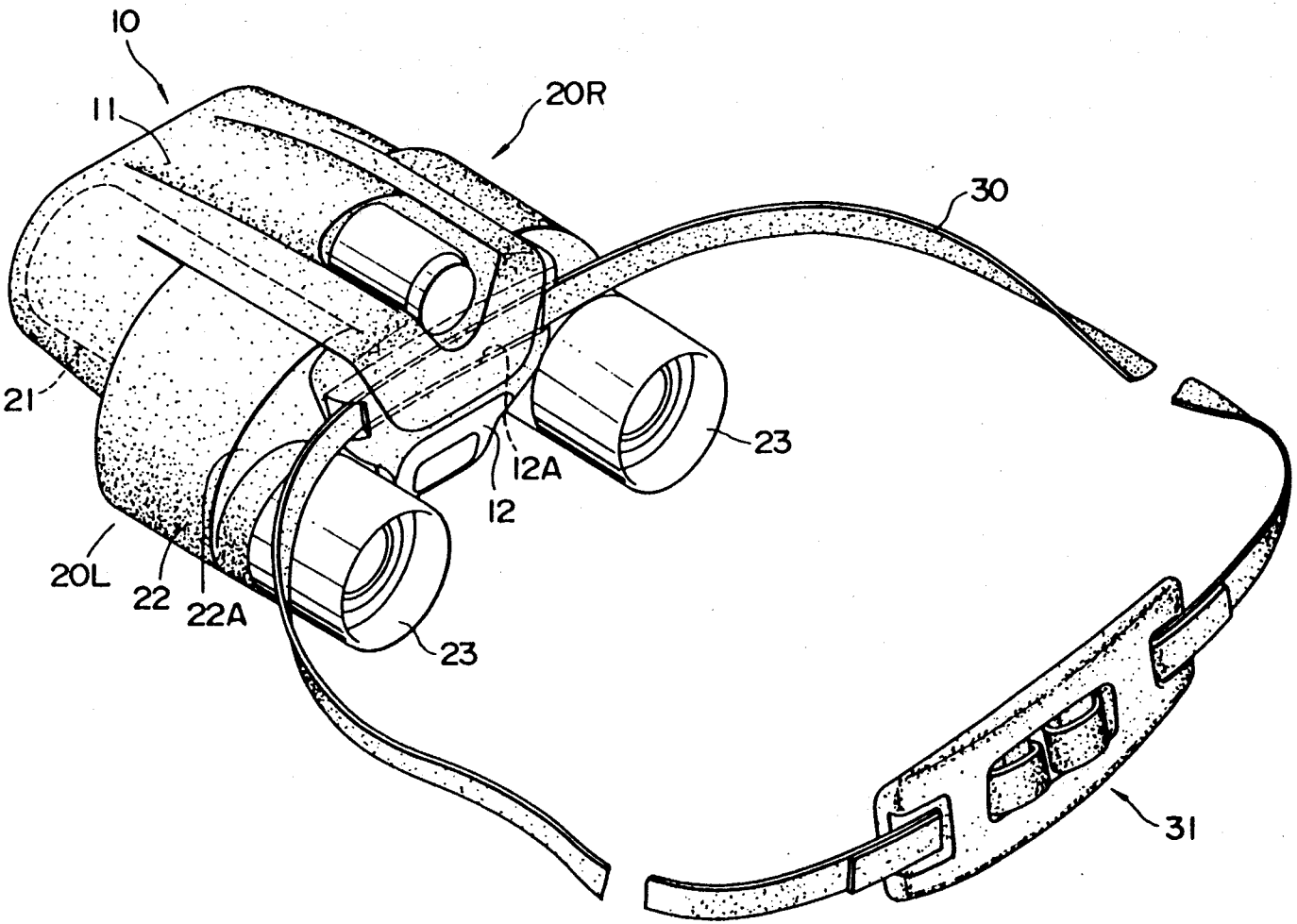
FIG. 1 is a perspective view showing a binocular with a strap embodying the present invention.
Figure 2:
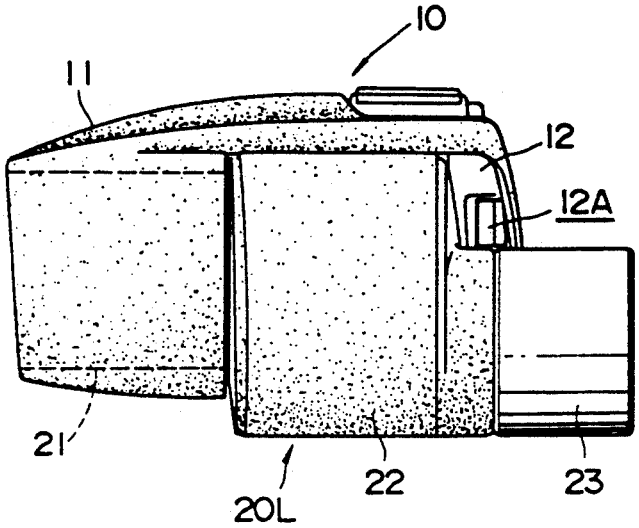
FIG. 2 is an side view of the binocular of FIG. 1.

FIG. 1 is a perspective view showing a binocular with a strap embodying the present invention, and FIG. 2 is a side view showing the binocular of FIG. 1.

A binocular 10 utilizes Poro prism as an erect prism, and includes a pair of right and left telescopic optical systems (20R, 20L) wherein an optical axis of each eyepiece is shifted by a predetermined distance with respect to the optical axis of corresponding objective lens. The right and left telescopic optical systems (20R, 20L) are constituted to be connected with a connecting holder member 11 in such a manner that optical axes of the objective lenses are disposed to be in parallel and spaced with each other by a predetermined distance.

In the telescopic optical system 20, a lens barrel 21 is installed into the connecting holder member 11 so that the lens barrel 21 can slidably move in the connecting holder member 11 in the direction of the optical axis of the objective lens. The rear part of the lens barrel 21 is integrally connected with a prism case 22. Further, the rear side 22A of the prism case 22 is retained by a rear cover 12 attached on a rear end of the connecting holder member 11 at the same side as an eyepiece portion 23, so that the optical axes of the eyepieces coincide with those of the objective lenses, respectively, and each eyepiece is constituted to be able to rotate about the optical axis of the corresponding object lens. That is, the right and the left telescopic optical systems 20R and 20L are respectively rotatable about the optical axis of the objective lens, and with this rotational movement, the distance between the eyepiece portions 23 of the right and left telescopic optical system can be changed, thus an adjustment for fitting the eyepiece portions 23 and 23 to respective eyes is attained.

The rear cover 12 is formed in a shape having a predetermined thickness such that it does not interfere with the swing movement of the eyepiece portion 23. Further, there is provided a through hole 12A extending horizontally in a transverse direction of the binocular 10 at a predetermined portion within the width of the rear cover 12.

The through hole 12A is formed to have a rectangular cross section having a longer side in an upper and lower direction of the binocular so that a strap 30, which is equipped with the binocular 10, can be inserted such that a longer side of the cross section of the strap 30 is disposed along the upper and lower direction. Further, the through hole 12A is formed not to interfere with the eyepiece portion 23 even if it is further extended horizontally outward in the its extending direction, i.e., the direction along the axis of the through hole 12A.

Figure 3:
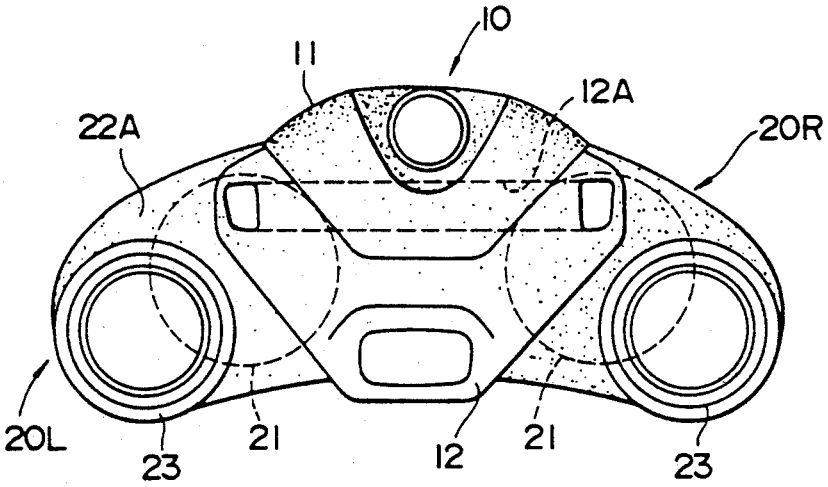
FIG. 3 is an rear view of the binocular shown in FIG. 1.

That is, in the binocular 10 in accordance with the present invention, when seen from the direction of the eyepiece portion 23 as shown in FIG. 3, a pair of eyepiece portions 23 are respectively disposed to the lower right and to the lower left of the rear cover 12 which is located at a center of the binocular 10 so that each eyepiece portion 23 can be swingable within a predetermined area. Still further, there is provided the through hole 12A extending horizontally in the right-and-left direction at the predetermined portion of the rear cover 12 located higher that the eyepiece portion 23.

In the binocular 10 constituted as described-above, after inserting one end of the strap 30 having a predetermined length into the strap through hole 12A, as shown in FIG. 1, both open ends of the strap 30 are connected to a buckle 31 so as to form an endless circle.

In accordance with the present invention, when the binocular 10 is hung from the neck or the shoulder through the strap 30, the strap 30 is substantially supported at the both openings of the strap through hole 12A, that is, each of the both openings of the strap through holes 12A acts as a fulcrum at which the strap 30 is bent. Therefore, the binocular 10 is supported at the two openings of the strap through holes 12A as if the strap 30 is supported at two-anchor points, and the eyepiece portion 23 is stably placed to face upwards.

Furthermore, when the strap 30 is inserted into the through hole 12A formed in the rear cover 12 and extending in the right-and-left direction, since the longer side of the rectangular cross section of the strap 30 is vertically extending, the strap 30 is likely to yield in back-and-forth direction of the binocular 10, i.e. the direction of the optical axis of the optical system of the binocular 10, therefore the strap 30 does not protrude towards eyes to disturb observation and is not an obstacle any more when the view finder portions 23 are placed to eyes for observation because the strap 30 is quite naturally held in a vertically extended condition along the direction of the strap through hole 12A even if the binocular is suddenly placed in front of eyes.

As is explained in the foregoing description, according to the construction for adapting the strap to the optical instrument, not only can the strap hold the binocular in a stable condition but also the connecting portion of the strap to the binocular body does not disturb an user who takes an observation through the eyepiece portion.

Figure 8:
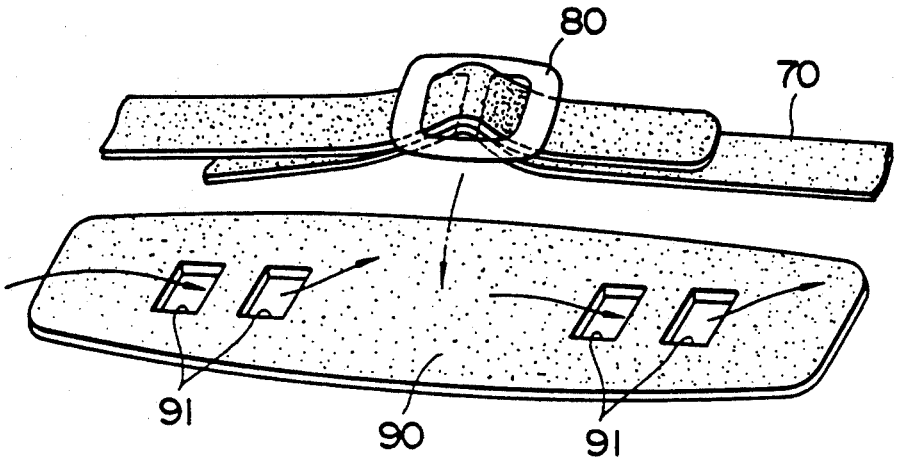
FIG. 8 PRIOR ART
FIGS. 8 and 9 are perspective view and a side view of a conventional buckle.

One example of a conventional buckle for adjusting the length of the strap is shown in FIG. 8. A metal fitting 80 is adopted as a buckle and both ends of strap 70 are overlapped and inserted into the metal fitting 80 so as to be fixedly held due to friction force caused between the metal fitting 80 and those overlapped ends of the strap 70.

Figure 9:
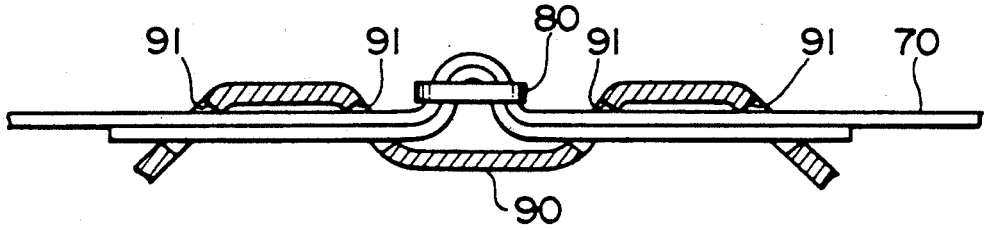
FIG. 9 PRIOR ART

In such a conventional construction, however, the connecting portion of the metal fitting 80 and the overlapped ends of the strap 70 becomes too thick to maintain a good appearance, and also this swollen connecting portion gives an uncomfortable feeling when it directly touches a neck or a shoulder. Furthermore, since the both open ends of the strap are piled up, it was troublesome to adjust the length of the strap, that is, more specifically, even if only one end of the strap is adjusted, the other end is apt to be pulled toward the same direction, and as a result, the strap is undesirably shifted which makes the adjustment troublesome. Regarding an improvement of the bad appearance and the bad grip, a shoulder pad 90 made of a flexible material as shown in FIG. 9 may be adapted. In this case, however, the strap 70 is inserted into holes 91 provided on the shoulder pad 90 as if it sews it. This is not desirable in view of an easy adjustment because the strap 70 is forced to be woven due to certain hardness of the shoulder pad 90, which makes the adjustment work difficult. On the other hand, when the strap 70 is tightened straight as shown in FIG. 9, the shoulder pad 90 is forced to be woven to the contrary. As above, in any way, an appearance is not good. Besides, the cost increases as much as this additional shoulder pad 90.

In order to overcome above problems, in the present invention, there is provided an improved buckle for the strap.

Figure 4:
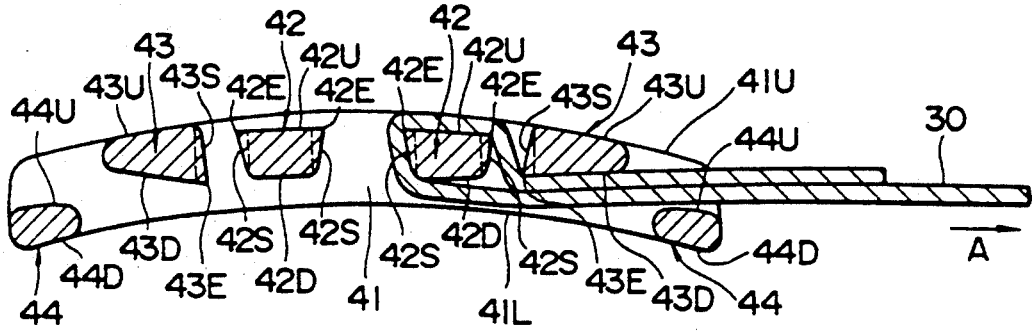
FIG. 4 is a cross-sectional side view of a buckle in accordance with the present invention.
Figure 5:
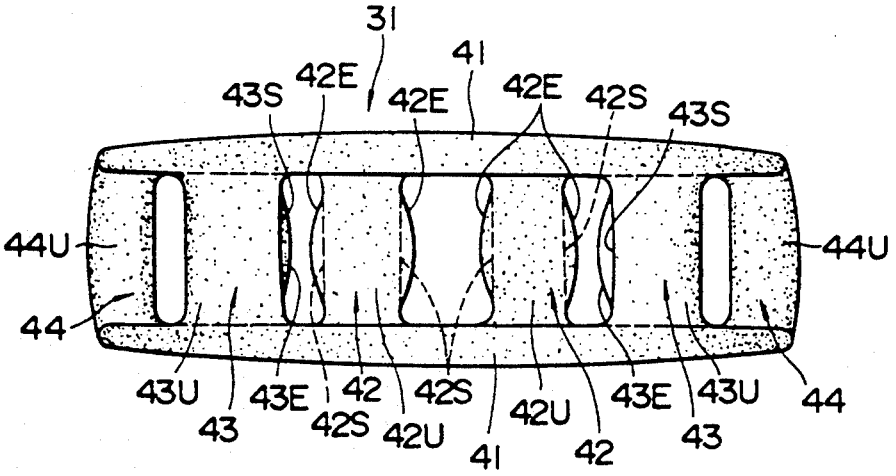
FIG. 5 is a plan view of the buckle of FIG. 4.

FIG. 4 is a cross-sectional side view showing a buckle for a strap in accordance with the present invention, and FIG. 5 is a plan view of the buckle of FIG. 4.

A buckle 31 has a pair of side plate portions 41, 41, which are connected with end crosspieces 44, 44 so as to form a rectangular frame-shaped configuration as shown in FIG. 5. A pair of hooking crosspieces 42, 42 and a pair of regulating crosspieces 43, 43 are respectively disposed symmetrically in a longitudinal direction about a center of the buckle 31. More specifically, the hooking crosspieces 42, 42 are disposed a predetermined distance spaced with each other at places close to the center of the buckle 31. Further, each of the regulating crosspieces 43, 43 is positioned next to the hooking crosspiece 42 but far away from the center of the buckle 31.

The side plate portion 41 is formed to have an upper and a lower edges 41U, 41L each being bent in an arc-shaped configuration. That is, the side plate portions 41 are straight and arrayed in parallel with each other when seen from the top or the bottom, but each side plate portion 41 is of arc-shaped when seen from the side. The hooking crosspieces 42, and 42 are connected with the side plate portion 41 in such a manner that the upper surface 42U is located to be lower than the upper edge 41U of the side plate portion 41 by a predetermined distance substantially equal to a thickness of a piece of strap 30. The lower surface 42D of the hooking crosspieces 42, and 42 are connected with the side plate portion 41 so as to be located higher than the lower edge 41L of the side plate portion 41 at a predetermined height greater than the thickness of a piece of strap 30. Moreover, the upper surface 42U is formed to have both side edges 42E, 42E each being arc-shaped when seen from the top so that the side edge 42E horizontally protrudes most at its center, as shown in FIG. 5. The side wall 42S and the upper surface 42U of the hooking crosspiece 42 constitutes at the side edge 42E an acute angle.

On the other hand, the regulating crosspiece 43 is connected with the side plate portion 41 in such a manner that an upper surface 43U is located at the same height as the upper edge 41U of the side plate portion 41. And, a lower surface 43D of the regulating crosspiece 43 is connected with the side plate portion 41 so as to be located at substantially the same height with the lower surface 42D of the hooking crosspiece 42 and to be located higher than the lower edge 41L of the side plate portion 41 at a predetermined height greater than the thickness of a piece of strap 30. Moreover, the lower surface 43D of the regulating crosspiece 43 is formed at one side close to the hooking crosspiece 42, a side edge 43E being arc-shaped when seen from the top so that the side edge 43E horizontally protrudes most at its center, as shown in FIG. 5. And a side wall 43S and the lower surface 43D of the regulating crosspiece 43 constitutes at the side edge 43E an acute angle.

The end crosspiece 44 is connected with the side plate portion 41 in such a manner that a lower surface 44D is located at the same height with the lower edge 41D of the side plate portion 41. And, an upper surface 44U of the end crosspiece 44 is connected with the side plate portion 41 so as to be located lower than the lower surface 43D of the regulating crosspiece 43 by a predetermined distance substantially equal to two times of the thickness of a piece of strap 30.

In accordance with the above arrangement, as shown in the right part of FIG. 4, the end of the strap 30 is inserted between the lower surface 43D of the regulating crosspiece 43 and the upper surface 44U of the end surface 44, and then is wound around the lower surface 42D, the side wall 42S, and the upper surface 42U of the hooking crosspiece 42 in this order so as to be folded back upward. The strap 30 is, in turn, further inserted between the hooking crosspiece 42 and the regulating crosspiece 43 and is then taken out via the lower surface 43D of the regulating crosspiece 43. And, by pulling the strap 30 outward, the strap 30 have a deep thrust between the side edge 42E of the hooking crosspiece 42 and the side edge 43E of the regulating crosspiece 43 due to arc-shaped acute edges 42E, 43E formed on the hooking crosspiece 42 and the regulating crosspiece 43. The crosspieces 42, 43, and 44 are arranged in such a fashion that when the strap 30 is pulled in the direction indicated by arrow A in FIG. 4, the strap 30 is tightly stretched and the overlapped portion of the strap 30 is press contacted to the edge 43E of the regulating crosspiece 43. Further, the strap 30 is engaged with the edges 42E, 42E, the strap 30 is prevented from slipping. It should be noted that the end crosspiece 44 regulate the direction in which a force is applied to the overlapped portion when the strap 30 is pulled.

Since the edges 42E, 42E, and 43E are arc-shaped, even if the strap 30 is pulled in the direction other than the direction orthogonal to the extending direction of the crosspieces 42, 43, and 44, i.e., if the tension force is applied to the strap 30 unevenly in the width direction thereof, the arc-shaped edges 42E, 42E, and 43E effectively function to prevent the slipping of the strap 30.

When it is required to adjust the length of the strap 30, the strap 30 located downward is fed into toward the hooking crosspiece 42 so as to be loosened. When the adjustment of the length of the strap 30 is completed, the strap 30 is again fastened by adding tension force.

In accordance with above arrangement, each open end of the strap 30 is independently fastened to the buckle 31 after the strap 30 is inserted into the through hole formed on the objective such as the camera or the binocular, and the length of the strap 30 can be adjustable by adjusting either of the strap 30 fastened to the buckle 31. Moreover, since the side plate portion 41 is formed to be an arc-shaped configuration, it becomes possible to maintain a sufficient gap between the upper surface 44U of the end crosspiece 44 and the lower surface 42D of the hooking crosspiece 42 or between the upper surface 44U of the end crosspiece 44 and the lower surface 43D of the regulating crosspiece 43, thus resulting in reducing the thickness of the buckle 31 as a whole. Moreover, if a radius of the arc along the side plate portion 41 of the buckle 31 is designed to fit a shoulder, the buckle 31 not only causes a sufficient grip force but brings a good appearance.

Figure 6:
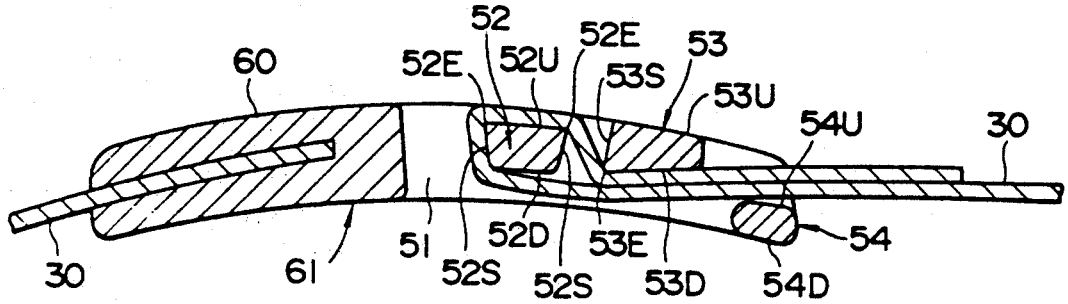
FIG. 6 is a cross-sectional side view of a modified buckle in accordance with the present invention.
Figure 7:
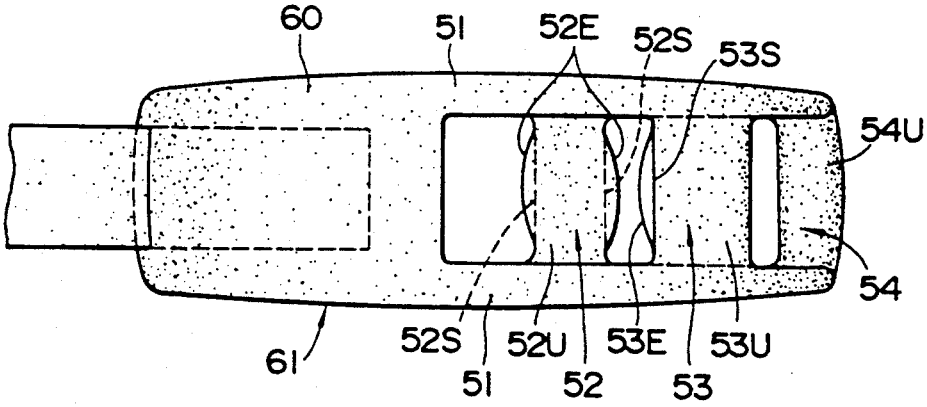
FIG. 7 is a plan view of the buckle of FIG. 6.

Though the above embodiment employs the symmetrical buckle which includes the right half and the left half each formed in the same fashion, the present invention is not limited to only symmetrical-type buckle. For example, FIG. 6 is a cross-sectional side view showing a modified embodiment of the buckle in accordance with the present invention, and FIG. 7 is a plane view of the buckle shown in FIG. 6.

In this second embodiment, only one side of the buckle 61 is formed to include an end crosspiece 54, a hooking crosspiece 52, and a regulating crosspiece 53. The other side 60 of the buckle 61 is formed such that one loose end of the strap 30 is fixedly inserted. In this modified embodiment, configurations of an upper surface 52U, side edges 52E, 52E, a side wall 52S, and a lower surface 52D of the hooking crosspiece 52 are the same as the corresponding portions of the hooking crosspiece 42 in accordance with the embodiment shown in FIG. 4. Similarly, configurations of an upper surface 53U, a side edge 53E, a side wall 53S, and a lower surface 53D of the regulating crosspiece 53 are the same as the corresponding portions of the regulating crosspiece 43 in accordance with the embodiment of FIG. 4. And an upper surface of the end crosspiece 54 is the same as that of the end crosspiece 44 of the embodiment of FIG. 4.

As is explained, in accordance with the buckle of the present invention, not only the adjustment of the strap length becomes easy but also it brings a good appearance. And, an attachment such as a shoulder pad required in a conventional buckle is, needless to say, not necessary, therefore, the cost can be decreased.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

The present disclosure relates to subject matters contained in Japanese Utility Model Application No. HEI 2-404523 filed on Dec. 25, 1990, and Japanese Patent Application No. HEI 2-332866 filed on Nov. 29, 1990, which are expressly incorporated herein by reference in their entireties.

What is claimed is:

1. A buckle for adjustablly connecting loose ends of a strap, comprising:

a pair of arc-shaped longitudinally extending side wall members, each of said side wall members having a bottom surface;

at least one hooking crosspiece extending transverse to said side wall members, both ends of said hooking crosspiece being connected to said pair of side members, respectively, said strip being wound around said hooking crosspiece and bent back to be overlapped;

at least one end crosspiece extending transverse to said side wall members, both ends of said end crosspiece being connected to end portions of said side wall members; and at least one interfering crosspiece extending transverse to said side wall members and arranged between said at-least-one hooking crosspiece and said at-least-one end crosspiece, both ends of said interfering crosspiece being connected to said pair of side wall members, an overlapped portion of said strap passed between said at-least-one end crosspiece and said at-least-one interfering crosspiece, wherein said overlapped portion of said strap is press contacted to an edge of said at-least-one interfering crosspiece when said strap is pulled relative to said buckle member and, wherein said at least one hooking crosspiece and said at least one interfering crosspiece are offset upwardly from said side wall members' bottom surface whereby said strap is maintained above said bottom surface.

2. The buckle according to claim 1, wherein said at-least-one interfering crosspiece is formed with a transversely extending edge portion to be press contacted and engaged with said overlapped portion of said strap; and wherein said at-least-one hooking crosspiece is formed with at least one transversely extending engaging edge portion to be engaged with said strap wound thereabout, said edge portion being directed toward said at-least-one engaging edge portion thereby preventing said strap from sliding when said strap is pulled relative to said buckle.

3. The buckle according to claim 2, wherein at least one of said edge portion and said at-least-one engaging edge portion is substantially arc-shaped, a center portion of which is protruded with respect to the side portions thereof in said transverse direction.

4. The buckle according to claim 1, wherein one loose end of said strap is fixedly secured to said buckle.

5. The buckle according to claim 1 comprising a pair of longitudinally spaced apart end crosspieces;

a pair of longitudinally spaced apart interfering crosspieces interposed between said pair of end crosspieces; and a pair of longitudinally spaced apart hooking crosspieces interposed between said pair of spaced apart interfering crosspieces wherein said buckle is symmetric about a line centrally disposed between said hooking crosspieces and parallel thereto.

* * * * *